United States Patent [19]

Vidal

[11] 4,297,708

[45] Oct. 27, 1981

[54] APPARATUS AND METHODS FOR CORRECTING DISPERSION IN A MICROWAVE ANTENNA SYSTEM

[75] Inventor: Paul Vidal, Paris, France

[73] Assignee: Societe d'Etude du Radant, Orsay, France

[21] Appl. No.: 918,152

[22] Filed: Jun. 22, 1978

[30] Foreign Application Priority Data

Jun. 24, 1977 [FR] France ..... 77 19364

[51] Int. Cl.[3] ..... H01Q 19/06

[52] U.S. Cl. ..... 343/754; 343/771

[58] Field of Search ..... 343/754, 854, 771

[56] References Cited

U.S. PATENT DOCUMENTS

| | | | |
|---|---|---|---|
| 2,959,783 | 11/1960 | Iams | 343/754 |
| 3,213,454 | 10/1965 | Ringenbach | 343/771 |
| 3,276,023 | 9/1966 | Dorne et al. | 343/754 |
| 3,354,461 | 11/1967 | Kelleher | 343/854 |
| 3,392,393 | 7/1968 | Spitz | 343/754 |
| 3,708,796 | 1/1973 | Bony | 343/754 |
| 3,961,333 | 6/1976 | Purinton | 343/909 |

FOREIGN PATENT DOCUMENTS

| | | |
|---|---|---|
| 2321044 | 4/1973 | Fed. Rep. of Germany . |
| 1329686 | 6/1963 | France . |
| 2224887 | 10/1974 | France . |

OTHER PUBLICATIONS

Free et al., High Power Constant-Index Lens Antenna, IEEE Transactions, AP, Jul. 1974.

Rozenfeld, Electromagnetic Theory of Three-Dimensional Inhomogeneous Lenses, A.P., May 1971.

Mayhan et al., Low Sidelobe, $K_a$-Band Antenna-Radome Study, A.P., Jul. 1975.

Radant-Copy of Verbal Presentation at 8th European Microwave Conference, Paris, 9-5-78.

*Primary Examiner*—Eli Lieberman

*Attorney, Agent, or Firm*—Finnegan, Henderson, Farabow, Garrett & Dunner

[57] ABSTRACT

A system for correcting for dispersion in a beam radiated by a flat microwave antenna due to variations in the frequency of operation by providing an electronically controlled phase shift of the beam in the plane of the dispersion. The methods consist of combining with the flat antenna a matrix of particular wire conductors of which certain are controlled such that the phase shift introduced by the matrix is able to correct for the dispersion of the flat antenna.

13 Claims, 6 Drawing Figures

APPARATUS AND METHODS FOR CORRECTING DISPERSION IN A MICROWAVE ANTENNA SYSTEM

BACKGROUND

Electronic scanning structures may scan in two orthogonal directions; cylindrical or conical structures assuring scanning in the plane containing the axis of the structure.

The present invention pertains to an electronic scanning method starting with a microwave beam emitted by a flat antenna, and to the applications of this method to the construction of structures permitting electronic scanning by a focused beam without dispersion caused by variations of the emitted frequency.

We know that the microwaves employed in radar systems employing either mechanical or electronic scanning processes may generate plane waves. These plane waves can be produced for example by an optical focusing system of non-directional spherical waves emitted by horns or by simple dipoles.

We well know the inconveniences of these systems, such as parabolic reflector or passive focusing lens, due to their bulkiness, their lack of manipulation, or difficulty in adjusting. There also exist systems emitting plane waves. These are flat antennas which can be made up of slotted wave guides, dipole stripline circuits or other forms of multifunction integrated circuits.

These flat antennas are made up of a juxtaposition of single radiating elements in rows and columns; each of these single elements is not fed individually but each line of elements is fed at one end in order to reduce the number of feeders.

These types of flat antennas are interesting in that they produce a focused plane wave without the addition of supplementary equipment. They possess however a well known but bothersome fault in that since these single elements which make up the flat antenna are fed in series at one end and not individually, the plane wave radiated by the flat antenna is not exactly parallel to the plane of the single elements; furthermore the direction angle this wave takes with respect to the perpendicular of the array plane varies with the frequency of the wave.

Certain authors have contended that one could obtain a scanning of the beam in a plane parallel to the slots of a slotted wave guide and perpendicular to the antenna array by varying the frequency of the radiated wave. What this describes is not in fact a true scanning but a variation in the pointing angle of the radiated beam in a very narrow and reduced region.

This variation is more a dispersion than a scanning since the possibility of scanning by varying the radiated frequency about a nominal frequency is very limited, because a flat antenna focuses its energy about a determined direction close to the direction perpendicular to the antenna plane only for those frequencies very close to the optimum or design frequency of the antenna.

It is possible however to cause scanning starting with the microwaves radiated by a flat antenna. Two solutions are known both of which have important disadvantages.

One solution consists in mechanically orienting a flat antenna. The beam radiated by a flat antenna which is subject to the above-mentioned dispersion is not always pointed in a direction perpendicular to the plane of the antenna and hence describes a cone. Accordingly, for scanning in a plane to be complete, a movement of the antenna along two perpendicular axes is indispensible.

The other solution consists of achieving an electronic scanning by placing phase shifters in series with each feed of the wave guides which make up the flat antenna. This solution may appear to cause a scanning in the direction perpendicular to the series of wave guides. This solution, however, is not satisfactory since the resulting scanning is in fact in a direction perpendicular to the dispersion caused by the variations in frequency and the effect of this dispersion is not compensated for.

The actual tendency for microwave scanning is to use a large enough frequency band of plus or minus ten percent of the nominal frequency centered about the nominal frequency. Accordingly, the effect of dispersion can not be ignored.

A flat antenna, even supplemented by a substantial aggregate of phase shifters, is difficult to control electronically and to use for high radiated power and will always have the major inconvenience of conical movement due to the beam dispersion for frequency variations during the scanning process.

The present invention has for its main objective the elimination of these problems and of furnishing methods and apparatus for electronic scanning starting with an electromagnetic wave radiated from a flat antenna in which there exists no dispersion in the pointing angle of the resultant beam when the radiated frequency varies about the nominal or design frequency of the flat antenna.

Additional objects and advantages of the present invention will be set forth in part in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, the apparatus for a non-dispersive microwave system comprises antenna means for radiating a microwave beam which exhibits variation in the direction of propagation of the beam in a first plane with variation in the frequency of the beam; lens means for controllably deflecting the direction of propagation of the beam in the first plane, the lens means comprising a plurality of networks located one behind the other, each in the direction of propagation of the beam and each network comprising a plurality of portions with said portions comprising first means for conducting, the first means for conducting being cut into sections, second means for conducting and a plurality of first means for switching having conductive and non-conductive states, the first means for switching being spaced apart on the second means for conducting to selectively render the second means for conducting discontinuous when the first means for switching is in the non-conductive state to assure a shift in the phase of the beam passing through the portions of the networks depending upon the conductive and non-conductive states of the first means for switching in said portions of the networks; and control means for setting the state of conduction of the first means for switching to establish phase shifts in the beam in said portions which phase shifts correct for the variation in the direction of propagation of the beam with variation in the frequency of the beam.

Preferably the antenna means comprises a set of parallel wave guides having slots lying in a second plane, the first and second means for conducting being parallel to each other and the first and second means for conducting being perpendicular to the axes of the wave guides.

Preferably the first and second means for conducting are embedded in a dielectric material in planes parallel to the second plane, the dielectric material both supporting the first and second means for conducting and aiding matching of the networks to the beam. The first means for switching are preferably diodes and the control means preferably includes second means for switching individually coupled to the second means for conducting to selectively control biasing of the diodes.

A method for correcting dispersion in a microwave system comprising the steps of: (a) radiating a beam from an antenna, the antenna having an intrinsic phase shift which varies the direction of propagation from the antenna in a first plane with the frequency of the beam; (b) selecting a desired direction of propagation of the beam from the antenna; (c) positioning a lens apparatus in front of the antenna in the path of the beam, the lens apparatus comprising a plurality of networks of first conductors cut into sections and of second conductors which selectively can be varied between being continuous and being sectioned by the biasing of switches placed on the second conductors at spacings of less than twice but not one half the wave length of said beam radiated from the antenna, each of the networks being located one behind the other, and the positioning placing the first and second conductors in the path of the beam in such a manner that the phase shift of the beam produced by biasing of the switches is exactly in the first plane; and (d) controlling the switches for each frequency of the beam to establish a phase shift for each frequency as a result of the conductors which, when combined with the instrinsic phase shift, results in the beam propagating in the desired direction.

The invention has equally as a purpose the applications of the process according to the invention to the construction of electronic scanning devices fed by flat antennas and which do not have dispersion problems.

DESCRIPTION OF THE DRAWINGS:

A greater appreciation of the objects and advantages of the invention may be understood by the following detailed description taken in conjunction with the drawings; wherein.

DETAILED DESCRIPTION

Reference will now be made to the present preferred embodiment of the invention, an example of which is illustrated in the accompanying drawings.

In order to build a device, conforming to the purposes of the invention and capable of assuring electronic scanning without dispersion in one plane, we construct a flat antenna from radiating elements set along wave guides and combine it with a network of parallel conductive wires.

Figure 1:
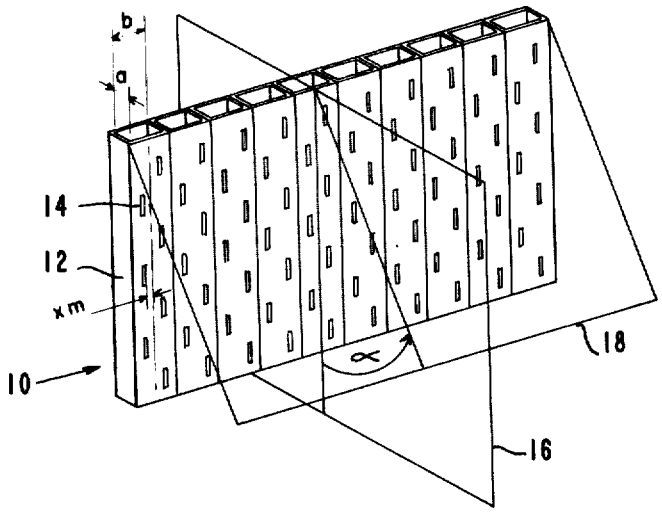
FIG. 1 is a diagram of a flat antenna used in conjunction with the present invention.

One suitable flat antenna 10 is illustrated in FIG. 1 as comprising a plurality of rectangular wave guides 12. Each wave guide 12 has on one face longitudinal slots 14 parallel to the axis of the wave guides 12. Wave guides 12 are typically end-fed and designed to radiate a flat microwave beam outward in a plane substantially parallel to the face of wave guides 12 at an optimum or design frequency.

However, as is well known to those skilled in the art, such prior art flat antennae exhibit variations in the direction of propagation of the beam in a first plane with variation in the frequency of the beam. For example, as shown in FIG. 1, a variation from the optium or design frequency of antenna 10 may result in a variation in the direction of propagation of the beam in a first plane 16. Thus, the beam no longer radiates outward from antenna 10 in a plane substantially parallel to the face of wave guides 12 as designed, but rather radiates outward in a plane 18 which lies at an angle $\alpha$ from the plane of wave guides 12 in first plane 16.

In accordance with the teachings of the present invention, a flat antenna is combined with a network of parallel conductors such as conductive wires.

These parallel conductive wires are preferably placed perpendicular to the wave guide axes in planes parallel to the face of wave guides 12 and are partly sectioned wires and partly wires which can be sectioned or made continuous by switches, such as by diodes fed by the wires on which they are mounted. As shown, for example, in FIG. 2, sectioned wires 20 and wires 22 with diodes 24 mounted thereon are shown embedded in a dielectric material 26 whose main purpose is to support them, but which also plays a microwave role to supplement that of the sectioned wires.

Figure 2:
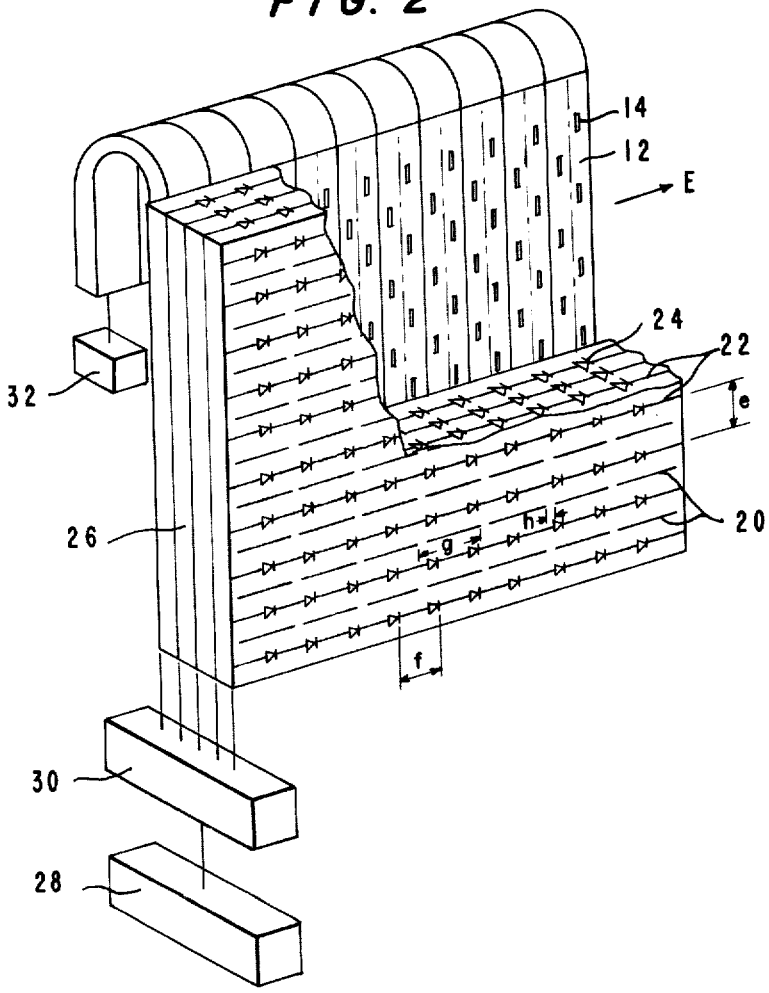
FIG. 2 is a diagram of the preferred embodiment of the present invention.

As shown in FIG. 2 and taught in U.S. Pat. No. 3,708,796 issued to Gilbert Bony, repeating networks of wires 20, wires 22 and diodes 24 are arranged in panels aligned in parallel planes, one behind the other. Generally, each panel splits an incident beam into as many parallel strips as there are wires 22 with diodes 24. The phase shift is uniform for each strip and may vary from one strip to another in the same panel and from one strip to another in different panels depending primarily on the choosen distance "f" between diode 24.

Figure 3:
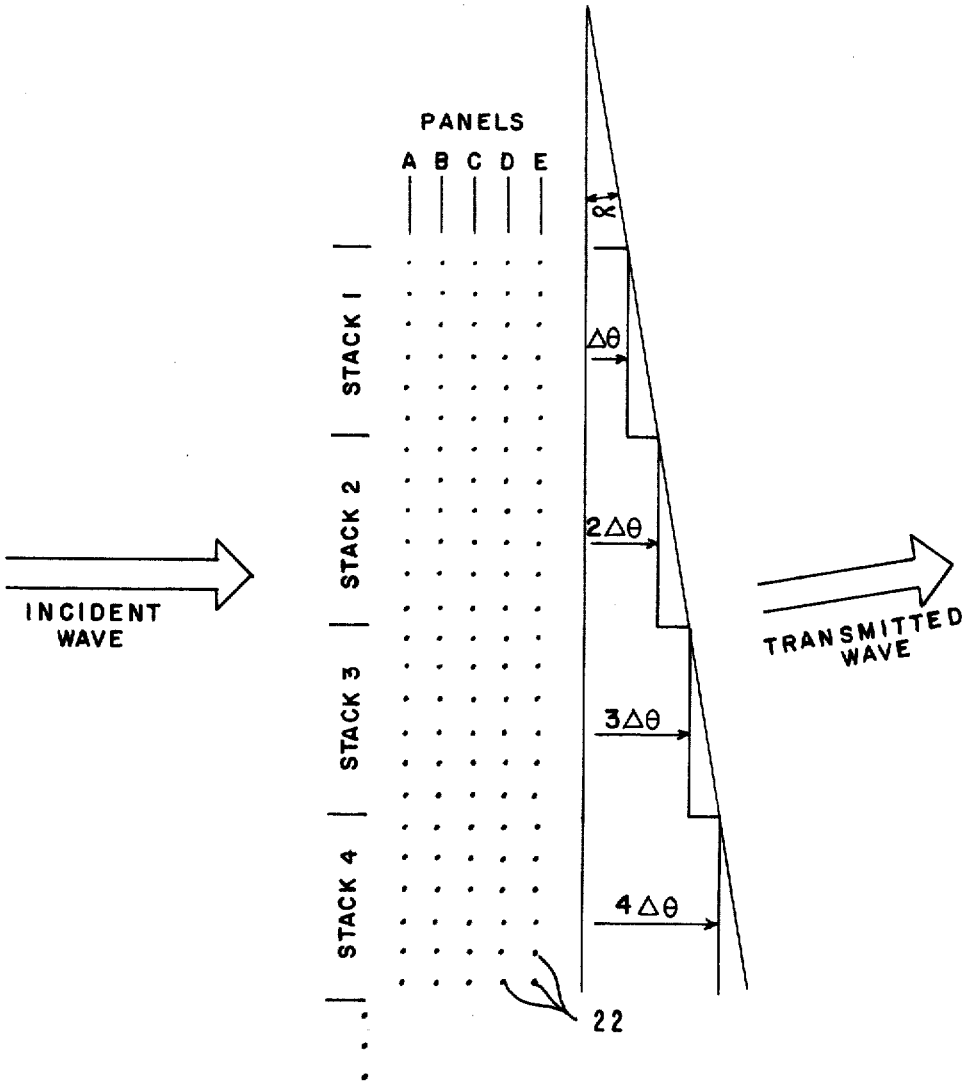
FIG. 3 is a diagram illustrating the scanning operation of the present invention.

The diversion of the direction of beam propagation or scanning effect of the flat lens shown in FIG. 2 is illustrated in FIG. 3. An end view of a lens apparatus is shown in FIG. 3. Dots represent wires 22 and wires 20 are omitted for clarity. Five panels A-E are shown aligned one behind the other. Wires 22 divide each panel into parallel strips and a plurality of adjacent parallel strips are identified by stacks 1-4. As used herein, a "portion" of networks of wires 20 and 22 can range from a single wire 22 to a group of wires 20 and 22 such as are in stacks 1-4.

For illustrative purposes, wires 22 may be considered as all having diodes 24 interspaced an equal distance "f"

which produces a phase shift $\Delta\phi$ for an incident wave when diodes 24 are nonconductive. Thus, when diodes 24 of stack 1 of panel A are non-conductive, but diodes 24 in stack 1 of panels B-E are conductive, a phase shift of $\Delta\phi$ occurs. In stack 2, panel A and panel B are non-conductive resulting in a phase shift of $2\ \Delta\phi$ for stack 2. Likewise, in stack 3, diodes 24 of panels A-C are non-conducting and in stack 4 diodes 24 of panels A-D are non-conducting. The culmulative effect of selectively rendering diodes 24 non-conductive and thus selectively rendering wires 22 discontinuous is to assure a shift in the phase of the incident wave in each portion of the networks identified in FIG. 3 in stacks 1–4 which results in deflecting the direction of propagation of the incident wave in the plane of FIG. 3 by a scan angle $\alpha$. As will be obvious to those skilled in the art, by proper selection of dielectric panel thickness,, of wire 20 and wire 22 spacing, of diode 24 distances on wires 22 and of the number of panels, such phase shifts of the incident wave can be brought about as required to achieve the desired control over scan angle $\alpha$.

The microwave wave guides 12 of FIGS. 1 and 2 may be powered by a division network which supplies the illumination law desired.

Figure 4:
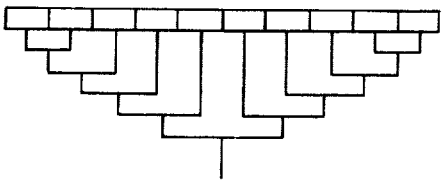
FIG. 4 is a diagram of a power divider which can be employed with the present invention.

These wave guides may, for example, be fed in phase by a wave guide power divider on the back side consisting of hybrid couplers in cascade as shown in FIG. 4. This division allows the measurement of a target angle in the plane perpendicular to the guide axis (i.e. the sum and difference channels). The longitudinal slots parallel to the axis of the wave guide couple the guide energy towards the interior resonating slots).

The coupled energy is a function of the eccentric distance Xm of each slot. The distribution of Xm on a guide is such that the energy radiated has an optimized low secondary lobe pattern.

Control of the diodes 24 is preferably obtained with the use of a computer 28 which, as a function of the chosen frequency, gives orders to forward or reverse bias wires 22 on which diodes 24 are mounted according to the correction scan angle desired. A suitable computer 28 may, for example, simply comprise a number of toggle switches, one for each wire 22. The switches may be set manually to experimentally determine the switch combination which gives rise to the desired scan angle $\alpha$. Computer 28 may also comprise electronically controlled switches which are set automatically by a standard card reader or other switchable device.

Preferably computer 28 controls a low voltage to a diode driver or feeder 30 which is capable of providing the magnitude of bias required to lines 22 upon receipt of a low voltage signal from computer 28.

Although one example of the present invention is shown comprising a flat antenna formed of slotted rectangular wave guides with longitudinal slots along the larger side of each of the rectangular guides, one could also build a flat antenna from dipoles excited with tuning stubs in each guide, the axis of which is parallel to the axis of the dipole and then add to these guides networks of parallel wires as shown in FIG. 2. One could equally build a flat antenna with striplines including couplers feeding the radiating slots, and add to this a system consisting of the parallel wire networks. These conductive wires preferably are positioned perpendicular to the wave guide axes in planes parallel to the face of the wave guides and will be partly sectioned wires and partly wires which can be made sectioned or continuous by switches such as by diodes fed in series by the wires on which they are mounted.

Given below is a non-limitive example of the description of an electronic scanning device for a non-dispersive focused beam.

With reference to FIGS. 1, 2 and 4 there are shown ten rectangular wave guides 12 of dimensions $a \times b$ (10.16 mm $\times\times$ 22.86 mm) placed smaller side by smaller side to build a flat antenna. The distance between slots 14 in wave guides 12 is 22 mm and the number of slots per guide is 60 (approximate span for a 1.4 meter antenna).

The corresponding radiation pattern in the plane containing the guide axis has a width of about 1.6 degrees at minus 3 dB, its maximum making an angle of 1.4 degrees to the normal of the network plane at a frequency of 9300 MHz. This angle situated in the plane containing the axis of the central guide varies as a function of the frequency by 1 degree every 100 MHz.

Networks of conductive wires are constructed with 2240 parallel wires 22 carrying 0.025 pf diodes 24 spaced in increments "f" of 8 mm.

Wires 22 are placed 10 mm apart "e" in a plane parallel to the plane of the wave guide network, with the axis of wires 22 being perpendicular to the axes of wave guides 12 and slots 14. Networks of diodes 24 and wires 22 are separated by a sheet of polyurethane foam (26) 6 mm in thickness, 16 networks of 140 leads may be employed in a system. Each cross section wire 22 is rectangular with dimension of $75 \times 160$ microns. Half way between each two diode wires 22 of the same network is placed a copper wire 20 having the same cross section as the diode wires and cut in increments (g) of 11.4 mm by a space (h) of 2 mm.

Diode feeder 30 is controlled by a computer 28 as a function of the emitted frequency of the power source 32 which gives the desired power illumination. With this device it is possible to obtain all pointing values less than 90° in a plane perpendicular to the network of wires without any scattering perturbation due to the variations in the radiated frequency. Particular applications of the electronic scanning process to devices which allow scanning by a focus beam without dispersion are enumerated below:

Networks of parallel conductive wires which can be made continuous or sectioned by means of diodes placed in series along these leads are combined with a flat slotted wave guide antenna. In this case the slots in the wave guides are longitudinal and placed on the large face of the guide, the feed to the guides is assured by a power divider giving the desired power illumination.

The diode lines placed parallel before the flat antenna are perpendicular to the wave guide axis. The electronic scanning takes place in the plane perpendicular to the diodes line and takes into account the frequency dispersion of the antenna.

In order to obtain an electronic scanning in two perpendicular planes, the flat slotted wave guide antenna and the network of conductive parallel wires are the same as the proceeding, the feed to the slotted wave guides is likewise done by using a power divider which this time is equipped with wave guide conventional phase shifters placed at the end of each guide. In this case additional phase shift by selectively controlling the conductive parallel wires to achieve scanning in this plane while the conventional phase shifters scan in a perpendicular plane.

The control of these phase shifters permits the scanning of a beam in the plane perpendicular to the wave guides. The whole device assures on one hand a scanning of the beam in a plane perpendicular to the wave guides by controlling the phase shifters and on the other hand in a plane parallel to the guide by controlling the wires networks and this takes into account the antenna dispersion with frequency.

In order to obtain an electronic scanning in one plane of staked beam radiated by a flat antenna we keep unchanged the flat antenna and the network of parallel conductive wires of diodes and we feed the wave guides using a power divider in the form of a "Butler Matrix" which gives as well to the radiated energy a stacked beam in the transversal sense of the wave guides.

These stacked beams are then deflected in the perpendicular plane as desired by the wire networks where the wires are made continuous or sectioned by the diodes whose control takes into account the dispersion in frequency of the flat antenna.

In order to obtain an electronic scanning in two planes perpendicular to the beam radiated by a flat antenna, we add to it two orthogonal systems of diode wire networks placed in the plane parallel to the antenna and separated one from the other by a polarization rotating grid.

The control of the wire network system which is perpendicular to the wave guide slots compensates for the dispersion in frequency of the antenna.

Figure 5:
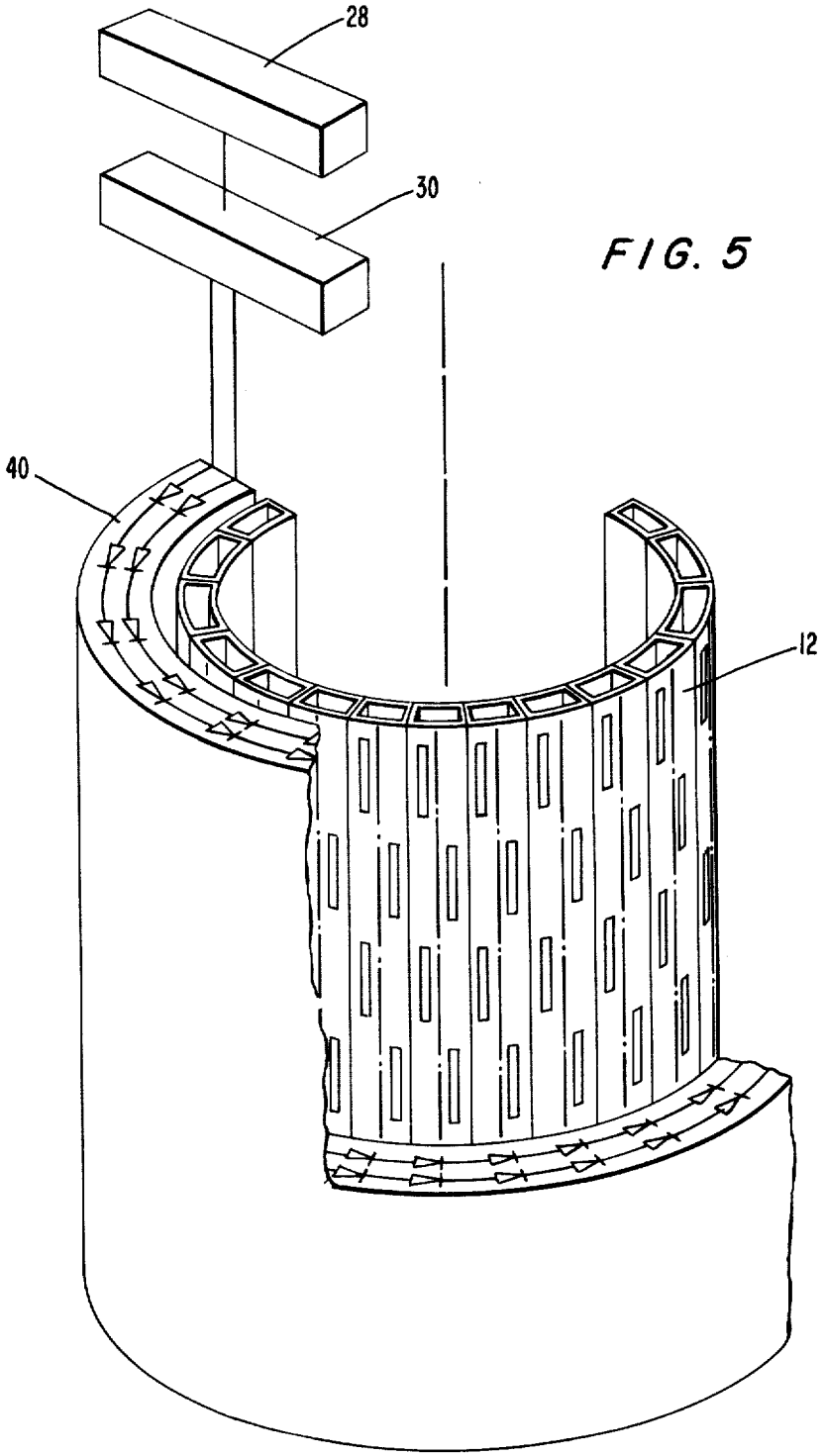
FIG. 5 is a diagram illustrating use of the present invention with a conical microwave antenna formed of waveguides put together on the generatrix of a cylinder; and, FIG. 6 is a diagram illustrating use of the present invention with a conical microwave antenna formed of waveguides put together on the generatrix of a cone.
Figure 6:
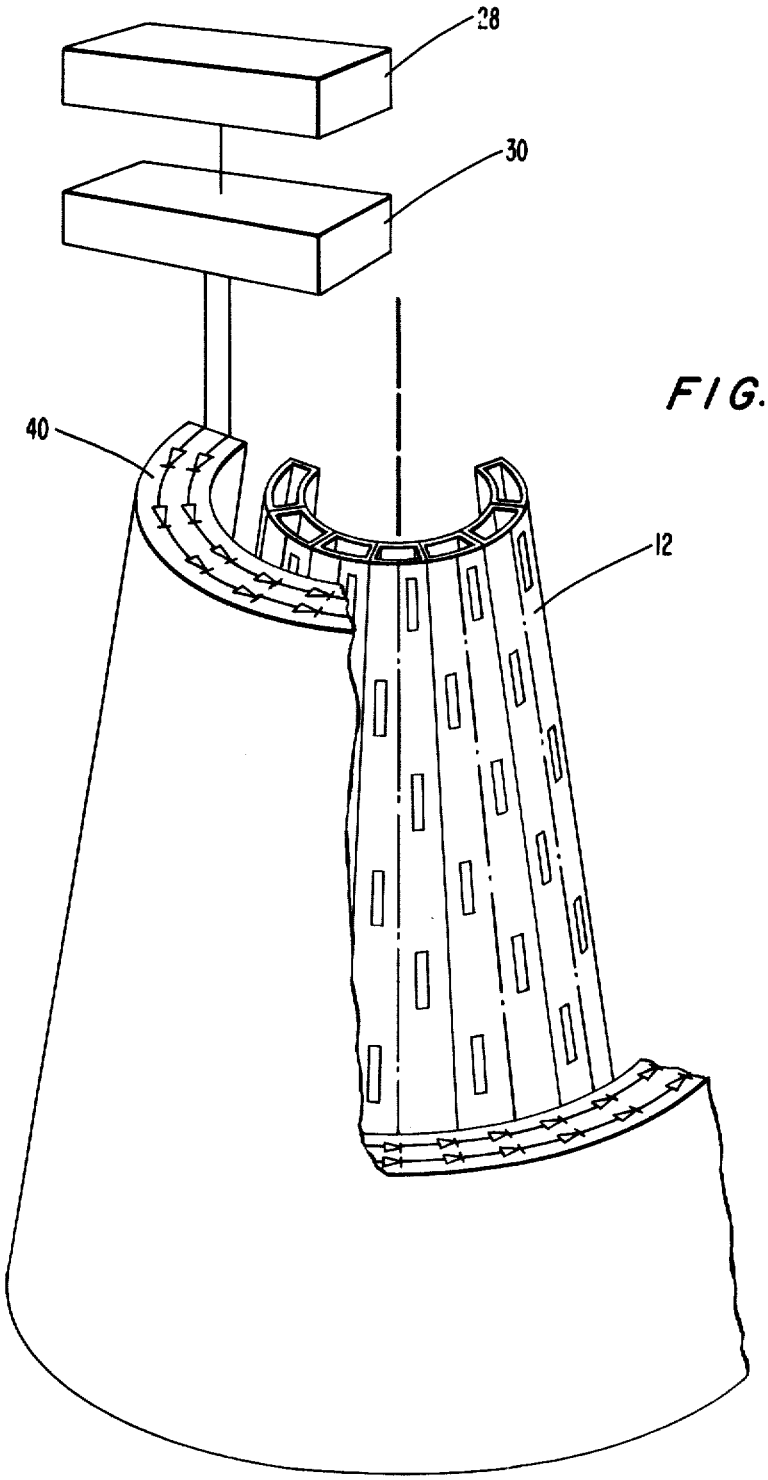

In order to obtain electronic scanning in a plane made up of the axis and a generatrix of a cylindrical (as shown in FIG. 5) or conical (as shown in FIG. 6) antenna, we add to this antenna, which consists of a juxtaposition of longitudinally slotted wave guides 12 placed together depending upon the geometry (cylinder or cone), parallel diode wire networks 40 which are placed following the external circumference of the surface of revolution of the antenna and centered about its axis. This slotted wave guide antenna is fed successively by sectors which causes a rotation of the radiated beam. The electronic scanning assured by the networks of wires of diodes is placed from each sector of the antenna, in a plane including the axis of revolution of the assembly and takes into account the dispersion in frequency.

While particular embodiments of the present invention have been shown and described, it will of course be obvious to one skilled in the art that certain advantages and modifications may be effected without departing from the spirit of the invention, and accordingly, it is intended that the scope of the invention not be determined by the foregoing examples but only by the scope of the appended claims.

What is claimed is:

1. A nondispersive microwave antenna system comprising:

(a) antenna means for radiating a microwave beam which exhibits variation in the direction of propagation of said beam in a first plane with variation in the frequency of said beam;

(b) lens means for controllably deflecting the direction of propagation of said beam in said first plane, said lens means comprising a plurality of networks located one behind the other, each in the direction of propagation of said beam and each network comprising a plurality of portions with said portions comprising first means for conducting said first means for conducting being cut into sections, second means for conducting and a plurality of first means for switching having conductive and non-conductive states, said first means for switching being spaced apart on said second means for conducting to selectively render said second means for conducting discontinuous when said first means for switching is in said non-conductive state to assure a shift in the phase of said beam passing through said portions of said networks depending upon said conductive and non-conductive states of said first means for switching in said portions of said networks; and (c) control means for setting the state of conduction of said first means for switching to establish phase shifts in said beam in said portions which phase shifts correct for said variation in the direction of propagation of said beam with variation in the frequency of said beam.

2. The system of claim 1 wherein said antenna means comprises a set of parallel wave guides having slots lying in a second plane, said first and second means for conducting being parallel to each other and said first and second means for conducting being perpendicular to the axes of said wave guides.

3. The system of claim 2 wherein said first and second means for conducting are embedded in a dielectric material in planes parallel to said second plane, said dielectric material both supporting said first and second means for conducting and aiding matching of said networks to said beam.

4. The system of claim 3 wherein said first means for switching are diodes.

5. The system of claim 4 wherein said control means includes second means for switching individually coupled to said second means for conducting to selectively control biasing of said diodes.

6. A flat microwave antenna, non-dispersive system comprising:

(c) antenna means for radiating a microwave beam which exhibits variation in the direction of propagation of said beam in a first plane with variation in the frequency of said beam;

(b) lens means for controllably deflecting the direction of propagation of said beam, said lens means comprising a plurality of first and second networks each divided into portions and said portions comprising first conductors cut into sections, second conductors, and a plurality of first means for switching having conductive and non-conductive states, said first means for switching being spaced apart on said second conductors to selectively render said second conductors discontinuous with said first means for switching in said non-conductive state to assure a shift in the phase of said beam passing through portions of said networks depending upon said conductive and non-conductive states of said first means for switching in said portions of said networks, said first and second conductors of said first networks lying parallel to each other, said first and second conductors of said second networks also lying parallel to one another, said first and second conductors of said first planar networks lying perpendicular to said first and second conductors of said second networks, said first networks positioned in front of said antenna means for deflecting the direction of propagation of said beam in said first plane and said second networks positioned in front of said antenna means for deflecting the direction of propagation of said beam perpendicular to the deflection of said first networks; and (c) control means for setting the state of conduction of said first means for switching in said first networks to establish phase shifts of said beam in said portions of said first networks which correct for said variation in the direction of propagation of said beam with variation in frequency of said beam, and for setting the state of conduction of said first means for switching in said second networks which provides for scanning of said beam without variation in the direction of propagation of said beam due to variation in the frequency of said beam.

7. The system of claim 6 wherein said antenna means comprises a set of end-fed parallel wave guides having slots lying in a second plane, said first and second conductors of said first planar network lying perpendicular to the axes of said wave guides.

8. The system of claim 7 wherein said first and second conductors of both said first and second networks are embedded in dielectric material in planes parallel to said second plane, said dielectric material both supporting said conductors and aiding matching of said first and second networks to said beam.

9. The system of claim 8 wherein said first means for switching are diodes.

10. The system of claim 9 wherein said control means includes second means for switching individually coupled to said conductors of said first and second networks to selectively control biasing of said diodes.

11. The system of claim 1 wherein said antenna means is fed by a power divider of the Butler Matrix type.

12. The system of claim 1 wherein said antenna means is a conical microwave antenna formed by the juxtaposition of wave guides of radiating elements put together on the generatrix of a cone or cylinder fed in groups of wave guides forming successive sections and said networks being placed along the exterior circumferences at the surface of revolution of the antenna and centered about its axis.

13. A method for correcting dispersion in a microwave system comprising the steps of:

(a) radiating a beam from an antenna, said antenna having an intrinsic phase shift which varies the direction of propagation from said antenna in a first plane with the frequency of said beam;

(b) selecting a desired direction of propagation of said beam from said antenna;

(c) positioning a lens apparatus in front of said antenna in the path of said beam, said lens apparatus comprising a plurality of networks of first conductors cut into sections and of second conductors which selectively can be varied between being continuous and being sectioned by the biasing of switches placed on the second conductors at spacings of less than twice but not one half the wave length of said beam radiated from said antenna, each of said networks being located one behind the other, and said positioning placing said first and second conductors in the path of said beam in such a manner that the phase shift of said beam produced by biasing of said switches is exactly in said first plane; and (d) controlling said switches for each frequency of said beam to establish a phase shift for each frequency as a result of said conductors which, when combined with said instrinsic phase shift, results in said beam propagating in said desired direction.

* * * * *